United States Patent [19]

Hopperdietzel

[11] Patent Number: 5,065,808

[45] Date of Patent: Nov. 19, 1991

[54] TAMBOUR DOOR FOR BOX-TYPE FURNITURE

[75] Inventor: Siegfried Hopperdietzel, Selb, Fed. Rep. of Germany

[73] Assignee: Rehau AG & Co., Rehau, Fed. Rep. of Germany

[21] Appl. No.: 610,067

[22] Filed: Nov. 7, 1990

[30] Foreign Application Priority Data

Nov. 16, 1989 [DE] Fed. Rep. of Germany ..... 8913557

[51] Int. Cl.[5] ..... E06B 9/00

[52] U.S. Cl. ..... 160/231.2; 160/229.1; 160/36

[58] Field of Search ..... 160/231.1, 113, 36, 160/229.1, 231.2, 232, 201, 202; 312/297

[56] References Cited

U.S. PATENT DOCUMENTS

| | | | |
|---|---|---|---|
| 332,921 | 12/1885 | Martinez | 160/231.1 |
| 2,324,398 | 7/1943 | Kahr | 160/231.1 X |
| 2,690,216 | 9/1954 | Scott | 160/231.2 X |
| 3,479,784 | 11/1969 | Massagli | 160/235 X |
| 3,717,247 | 2/1973 | Moore | 160/231.1 X |
| 4,577,352 | 3/1986 | Gautheron | 160/229.1 X |
| 4,882,799 | 11/1989 | Shapiro | 160/231.1 X |
| 4,901,436 | 2/1990 | Gosch et al. | 160/231.2 X |

FOREIGN PATENT DOCUMENTS

| | | |
|---|---|---|
| 2111317 | 5/1972 | Fed. Rep. of Germany . |
| 7913550 | 8/1979 | Fed. Rep. of Germany . |

*Primary Examiner*—Blair M. Johnson

*Attorney, Agent, or Firm*—Spencer & Frank

[57] ABSTRACT

A tambour door for box-type furniture, including at least one tambour door element comprised of a plurality of profiled members which are rods and which have hollow, trapezoidal cross-sections each including a base, a pair of arms, and a top, which top comprises a side of the tambour door elements to be viewed and which is wider than the base; and a plurality of hinge members each consisting essentially of a flexible polymeric film for articulately interconnecting the plurality of profiled members longitudinally along adjacent bases thereof.

8 Claims, 2 Drawing Sheets

FIG. 3
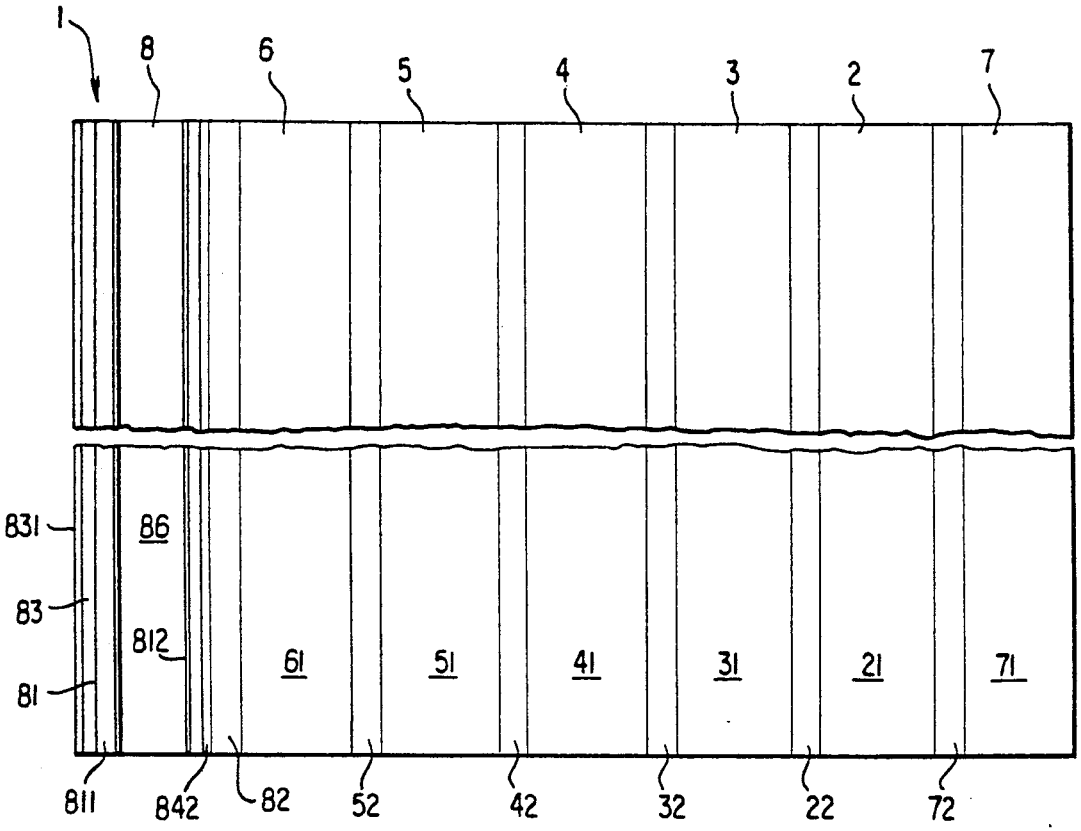
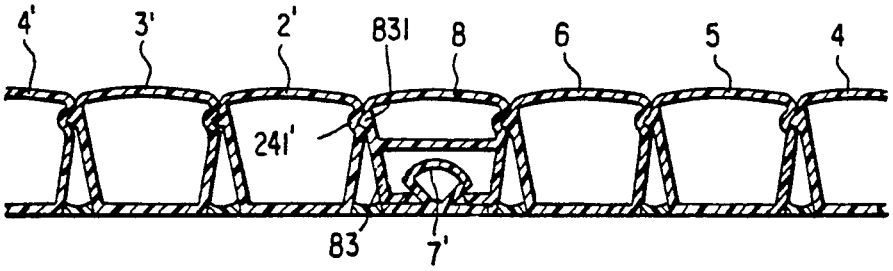
FIG. 4

TAMBOUR DOOR FOR BOX-TYPE FURNITURE

CROSS-REFERENCE TO RELATED APPLICATION

This application claims the priority of Application Ser. No. 89 135 57.1, filed Nov. 16th, 1989 in the Federal Republic of Germany, the subject matter of which is incorporated herein by reference.

BACKGROUND OF THE INVENTION

1. Field of the Invention

The invention relates to a tambour door for box-type furniture composed of individual profiled members and connecting means for the articulated fastening of the individual profiled members to one another.

2. Background of the Related Art

Tambour doors composed of individual profiled members are known in many forms. For example, Federal Republic of Germany AS-2,111,317 discloses a hollow, profiled, tambour door rod made of an extrusion molded plastic whose cross-section is composed of at least one closed chamber having two main walls which are curved in the same direction and are arranged at a small distance from one another. The center points of the curvatures of these main walls lie on the side facing a tambour door roller. The main walls are connected to one another by means of connecting webs, with one of the connecting webs being provided with a hook which is bent away from the tambour door roller, while the other connecting web is provided with an insertion slot for receiving the hook of the adjacent profiled rod. The curvature of the main walls and the articulation of the hook-slot connections in this prior art tambour door determine the magnitude of the windup radius of the tambour door element. With such tambour door constructions it is possible to cover window openings, as well as cabinet openings.

Other tambour doors are known specifically for use on cabinets and are composed of a rollable laminated plate provided with transverse reinforcements arranged transversely to the rolling direction. An example of this structural arrangement is disclosed in Federal Republic of Germany U-79 13 550. Such tambour doors for cabinets have the drawback, however, that they must be individually manufactured for each specific design application because dimensional modifications are limited. Cabinet designs requiring modification, for example, lengthening, are not possible according to this structural arrangement and method of manufacture.

SUMMARY OF THE INVENTION

It is therefore an object of the present invention to provide a tambour door for box-type furniture construction, such as cabinets, which builds on the knowledge of the prior art, but permits design modification and adaptation to a multitude of possible uses.

This object is accomplished according to the present invention by providing a tambour door for box-type furniture including at least one tambour door element comprised of a plurality of profiled members which are rods and which have hollow, trapezoidal cross-sections each including a base, a pair of arms, and a top, which top comprises a side of the tambour door element to be viewed in use and is wider than the base; and a plurality of hinge members each consisting essentially of a flexible polymeric film for articulately interconnecting the plurality of profiled members logitudinally along adjacent bases thereof. Such tambour door elements are preferably made of plastic materials coextruded as an interconnected unit.

Such a tambour door element may be configured so that the pair of arms of each of the plurality of profiled members has one arm which is provided with a protruding portion and another arm which is provided with an indented portion. Then, adjacent profiled members have respective contact regions at which the protruding portion of one arm of one of the adjacent profiled members and the indented portion of one arm of another of the adjacent profiled members matingly accommodate one another, for example in a tongue and groove manner.

Moreover, the plurality of profiled members of such a tambour door element may include a female end member and a male end member, which male end member is provided on an end of the tambour door element opposite the female end member for interconnecting adjacent tambour door elements, when more than one tambour door element is provided, by retaining at least a portion of the male end member of one adjacent tambour door element within the female end member of another adjacent tambour door element. Advantageously, the female end member has a hollow, trapezoidal cross-section including a base, a pair of arms and a top, and has an aperture which is groove-shaped defined in the base thereof for receiving at least a portion of the male end member in the well-known tongue and groove manner.

The male end member has a base having a predetermined wall thickness. Advantageously, the base of the female end member is set back by the wall thickness of the base of the male end member so that the base of the male end member is flush with the bases of the remaining profiled members and lies in the same plane therewith when assembled and matingly accommodated within the female end member of an adjacent tambour door element.

The aperture of the female end member has a predetermined cross-sectional aperture width. When the male end member includes a tongue, which has a mushroom-like profile in cross-section and projects from the base of the male end member, the tongue of the male end member advantageously has a cross-sectional width which, in the region of its greatest expanse, is greater than the cross-sectional aperture width of the female end member.

The tambour door may have more than one tambour door element so as to vary the effective length/width thereof (hereinafter width). Then, the base of the female end member of one adjacent tambour door element is provided with wall regions which define the groove-shaped aperture thereof so that the tongue of the male member of another adjacent tambour door element is retained within the aperture of the female end member by the wall regions thereof. Retention may be by a tight snap-fit, relying on the resiliency of the plastic materials, or a slip-fit requiring insertion from one extremity.

The female end member may advantageously be provided with an interior reinforcement web which extends longitudinally therethrough and which extends between and connects the pair of arms to reinforce the member.

Thus, the present invention provides a tambour door system for box-type furniture including at least one tambour door element each comprised of a plurality of profiled members and a plurality of hinge members consisting essentially of a flexible polymeric film. Each of the plurality of profiled members (a) are elongate rods arranged in parallel to one another, (b) include a female end member, a male end member provided on an end of the tambour door element opposite the female end member for interconnecting adjacent tambour door elements when more than one tambour door element is provided by retaining at least a portion of the male end member of one adjacent tambour door element within the female end member of another adjacent tambour door element, and a plurality of internal profiled members each having a hollow, trapezoidal cross-section including a top, a base which is narrower than the top, and a pair of opposing arms connecting the top and the base, and (c) are articulately interconnected by the plurality of hinge members longitudinally along adjacent bases thereof.

According to the invention, it is thus proposed to connect a plurality of individual profiled members by way of hinges made of polymeric film so as to form a tambour door element and to provide essentially tongue and groove shapes to end members of each tambour door element. Such profiled members include a profiled end member having a groove opening, i.e., a female end member, on the one hand, and a profiled end member including a tongue, i.e., a male end member on the other hand, so as to join two adjacent tambour door elements to one another thereby permitting extension of the width of the tambour door element practically at will.

The manufactured combination of several individual, profiled members into a unitized tambour door element, such as by coextrustion, with the individual profiled members each being connected to one another by film hinges, results in facilitation of assembly work and a considerable savings of time. Instead of threading hooked webs into associated slot openings of subsequent profiled members for each individual profiled member as was done by the prior art, the tambour door elements according to the present invention require joining procedures only for producing required widths in excess of the coextruded width of one manufactured tambour door element.

Compared to prior art tambour door elements, including structures having thin rollable sheets and transverse reinforcements, the use of the tambour door element according to the present invention results in the advantage that the structural length and width of the tambour door system can be varied as desired. The manufactured tambour door element can easily be coextruded in virtually any length and adapted to the required structural width by joining a plurality of such elements together as desired. Any extrudable/coextrudable plastic materials may be used and these are well-known in the art. For example, the profiled members may be made of a rigid polypropylene and the hinge members may be made of a mixture of polypropylene with Ethylene-propylene-Dien Monomer EPDM (i.e. Santoprene of the firm Monsanto).

Advantageously, the individual profiled members are trapezoidal hollow rods i.e., tubes, on which the film hinges are provided as profiled member-connecting polymer bridges on their narrower bases facing away from an aesthetic side to be viewed by a user, i.e., the viewing side, herein defined by the respective tops of the tambour door elements. Moreover, the individual profiled members are given a protruding portion, which may be a thickened profile portion, at the arms of the profiles in the contact region, on the one hand, and an indented portion, which may be a constriction profile portion, for accommodating the associated thickened profile, on the other hand. This measure strengthens the tambour door when it is in its closed state.

The aperture or groove opening for the connection of two tambour door elements according to the present invention is advantageously provided in the base of the female end member, an outer hollow rod. It is favorable for the total structure that the base of the female end member, an outermost hollow rod, is set back by its wall thickness. In the manufacture of the tambour door element, the wall thickness of this hollow end rod is made equal with the wall thickness of the male end member, which is, for example, a profiled member provided with a tongue. In this way, the establishment of a tongue-and-groove connection creates a connecting profile which is flush and coplanar with, and completely corresponds in extent to the other individual profiled members of the tambour door element and is aesthetically pleasing to the eye.

To provide additional strengthening, the hollow rod equipped with the groove opening (female end member) may be provided with an internal reinforcing web which connects the arms of this profiled member.

The tongue profile required to establish the tongue-and groove connection may be a mushroom-like detent element which projects from the base of the male end member and which, in the region of its greatest expanse, is thicker than the free passage opening of the groove opening, i.e., cross-sectional aperture, of the female end member. This mushroom-like detent element may have dimensions selected so that it can be pressed into the groove opening of the associated hollow connecting rod (female end member) or may be pulled into it from the side.

In this state, the facing free ends of the wall regions of the base defining the groove opening in the female end member, an outer hollow rod, pass behind the outer regions of the associated mushroom-like detent element to provide a firmly held together assembly of two tambour door elements.

BRIEF DESCRIPTION OF THE DRAWING

FIG. 3 is a rear plan view of a tambour door element according to the invention; and FIG. 4 is a partial cross-sectional side view showing interconnection of two adjacent tambour door elements into a tambour door system.

DESCRIPTION OF THE PREFERRED EMBODIMENTS

Figure 1:
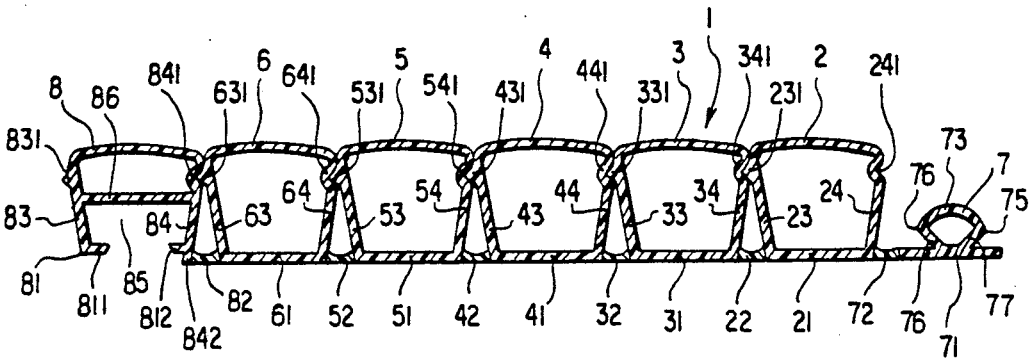
FIG. 1 is a cross-sectional side view of a tambour door element according to the invention.
Figure 2:
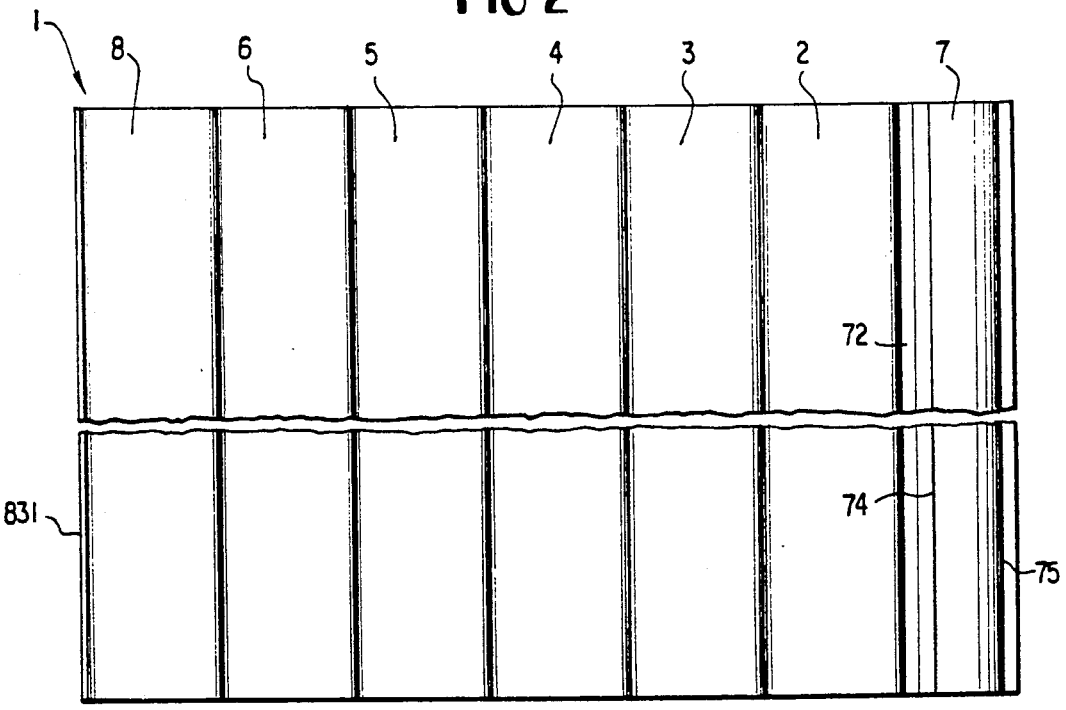
FIG. 2 is a top plan view of a tambour door element according to the invention which is the side of the tambour door to be viewed in use and, as such, is designed to be aesthetically pleasing.

FIG. 1 is a cross-sectional side view of a tambour door element 1 according to the invention. The illustrated tambour door element 1 includes five, identically-sized profiled members 2, 3, 4, 5 and 6, which are internal profiled members 2, 3, 4, 5 and 6. These individual profiled members 2, 3, 4, 5 and 6 are rod-shaped, as is more clearly shown in FIGS. 2 and 3, a top plan view and a rear plan view, respectively, and are firmly connected to one another longitudinally along respective edges of adjacent bases 21, 31, 41, 51 and 61, by a plurality of hinge members 22, 32, 42, and 52, respectively, which are strips of flexible polymeric film. This connection may be effected in the original shaping process during manufacture of the individual profiled members by employing coextrusion techniques in which, for example, plastics of different hardnesses are connected with one another in one process step while both are in the molten state.

As shown in cross-section in FIG. 1, profiled members 2, 3, 4, 5 and 6 each have respective bases 21, 31, 41, 51 and 61: respective pairs of arms 23, 24: 33, 34: 43, 44; 53, 54: and 63, 64: and tops 2, 3, 4, 5, and 6. Bases 21 thru 61 are connected to top 2 thru 6 by pairs of arms 23, 24 thru 63, 64.

Individual profiled members 2, 3, 4, 5 and 6 are aligned in parallel to one another and, in contact regions between adjacent members, arms 23, 33, 43, 53 and 63 are each provided with respective protruding portions 231, 331, 431, 531 and 631, shown as thickened profiles 231, 331, 431, 531 and 631, and opposing arms 24, 34, 44, 54 and 64 of respective pairs of arms are each provided with respective indented portions 241, 341, 441, 541 and 641, shown as profile constrictions 241, 341, 441, 541 and 641. The indented portions 241 thru 641 are positioned at the same level as and in mating correspondence with, the thickened profile portions 231 thru 631. In the closed, planar state of the tambour door shown in FIG. 1, respective thickened profile portions 231 thru 531 are mated with, accommodated by, and lie at least in part within, respective profile constrictions 341 thru 641 of adjacent profiled members.

By way of a hinge member 72, base 71 of male end member 7, shown as tongue 73 having a tongue profile is connected to and articulates with base 21 of internal profiled member 2.

The tongue profile of tongue 73 of male end member 7 is shown as a mushroom-like detent element 73 provided on base 71 and having a rounded head and connecting arms 76, 77 which extend toward one another in a straight line from regions of greatest expanse 74 and 75 of the rounded head to base 71. The illustrated view serves, however, as an example of the configuration of such a detent element 73 and is not intended as a limitation. Detent element 73 may have other cross-sectional shapes which enable it to provide a cross-sectional profile for male end member 7 which may be retained within female end member 8 for side-by-side interconnection of two tambour door elements 1, 1' as shown in FIG. 4.

At the opposite end of the tambour door element 1 illustrated in FIG. 1, is provided female end member 8. Female end member 8 is a hollow rod 8 having defined therein a cross-sectional aperture 85, which is a groove opening 85, and is firmly hinged to internal profiled member 6 by hinge member 82, which is a flexible polymeric film. Female end member 8 is has a hollow, generally trapezoidal cross-section including wall regions 811 and 812 as a base, top 8, and a pair of arms 83, 84 joining wall regions 811 and 812 to the top 8. The groove opening 85 is made in base 81 of female end member 8 so as to extend longitudinally with wall regions 811 and 812 of base 81 delimiting the groove opening 85. The base 81 of female end member 8 is set back toward the interior of female end member 8 by a distance equal to the wall thickness of base 71 of male end member 7, with a region 842, to which hinge member 82 is attached, left standing, i.e., extending from arm 84.

An indented portion 841, shown as profile constriction 841, is made in profile arm 84. This indented portion 841 corresponds to indented portions provided in internal profiled members 2 thru 6 but engages, in the illustrated embodiment, protruding portion 631, shown as thickened profile portion 631, of the adjacent internal profiled member 6. A protruding portion 831, shown as thickened profile portion 831, is formed on oppositely-disposed arm 83 of the female end member 8 so as to matingly engage a corresponding indented portion 241' of a juxtaposed profiled member 2' of a second tambour door element 1' as shown in FIG. 4.

Finally, as shown in FIG. 1, in the region where indented portion 841 begins, female end member 8 is provided with an interior reinforcement web 86 which connects the pair of arms 83 and 84. This reinforcement web 86 serves to increase the strength of profiled female end member 8.

It will be understood that the above description of the present invention is susceptible to various modifications, changes and adaptations, and the same are intended to be comprehended within the meaning and range of equivalents of the appended claims.

What is claimed is:

1. A tambour door for box-type furniture, comprising:

at least one tambour door element comprised of a plurality of profiled members which are elongate tube and which have hollow, trapezoidal cross-sections each including a base, a pair of arms, and a top, which arms extend from lateral edges of said base to lateral edges of said top, and which top comprises a side of the tambour door element to be viewed in use and is wider than the base; and a plurality of hinge members each consisting essentially of a flexible polymeric film articulately interconnecting adjacent profiled members of the plurality of profiled members longitudinally along only adjacent lateral edges of said bases, wherein each said at least one tambour door element is comprised of plastic materials coextruded as an interconnected unit.

2. A tambour door system for box-type furniture, comprising:

at least one tambour door element each comprised of a plurality of profiled members comprised of a plastic material and a plurality of hinge members consisting essentially of a flexible polymeric film, wherein said plurality of profiled members are elongate tubes arranged in parallel to one another, wherein said plurality of profiled members include a female end member, a plurality of internal profiled members, and a male end member provided on an end of the tambour door element opposite the female end member for interconnecting adjacent tambour door elements when more than one tambour door element is provided by retaining at least a portion of the male end member of one adjacent tambour door element within the female end member of another adjacent tambour door element, the plurality of internal profiled members each having a hollow, trapezoidal cross-section including a top, a base which is narrower than the top, and a pair of opposing arms connecting the top and the base, wherein said plurality of profiled members are articulately interconnected by the plurality of hinge members longitudinally along adjacent bases thereof, and wherein each said at least one tambour door element is coextruded as an interconnected unit.

3. A tambour door for box-type furniture, comprising:

at least one tambour door element comprised of a plurality of profiled members which are elongate tubes and which have hollow, trapezoidal cross-sections each including a base, a pair of arms, and a top, which top comprises a side of the tambour door element to be viewed in use and is wider than the base; and a plurality of hinge members each consisting essentially of a flexible polymeric film for articulately interconnecting adjacent profiled members of the plurality of profiled members longitudinally along adjacent bases thereof, wherein the plurality of profiled members includes a female end member and a male end member, which male end member is provided on an end of the tambour door element opposite the female end member for interconnecting adjacent tambour door elements when more than one tambour door element is provided by retaining at least a portion of the male end member of one adjacent tambour door element within the female end member of another adjacent tambour door element, which female end member has a hollow, trapezoidal cross-section including a base, a pair of arms and a top, and has an aperture which is groove-shaped defined in the base thereof for receiving at least a portion of the male end member.

4. The tambour door as defined in claim 3, wherein the male end member has a base having a wall thickness, and wherein the base of the female end member is set back by the wall thickness of the base of the male end member.

5. The tambour door as defined in claim 4, wherein the aperture of the female end member has a cross-sectional aperture width, wherein the male end member has a tongue which has a mushroom-like profile in cross-section and which projects from the base of the male end member, and wherein the tongue of the male end member has a cross-sectional width which, in the region of its greatest expanse, is greater than the cross-sectional aperture width of the female end member.

6. The tambour door as defined in claim 3, wherein the aperture of the female end member has a cross-sectional aperture width, wherein the male end member has a tongue which has a mushroom-like profile in cross-section and which projects from the base of the male end member, and wherein the tongue of the male end member has a cross-sectional width which, in the region of its greatest expanse, is greater than the cross-sectional aperture width of the female end member.

7. The tambour door as defined in claim 6, wherein more than one tambour door element is provided, wherein the base of the female end member of one adjacent tambour door element has wall regions which define the groove-shaped aperture thereof, and wherein the tongue of the male member of another adjacent tambour door element is retained within the aperture of the female end member by the wall regions thereof.

8. The tambour door as defined in claim 3, wherein the female end member is provided with an interior reinforcement web which extends longitudinally therethrough and which extends between and connects the pair of arms.

* * * * *